US006947826B2

(12) United States Patent
Deibert et al.

(10) Patent No.: US 6,947,826 B2
(45) Date of Patent: Sep. 20, 2005

(54) METHOD FOR COMPENSATING INJECTION QUALITY IN EACH INDIVIDUAL CYLINDER IN INTERNAL COMBUSTION ENGINES

(75) Inventors: Ruediger Deibert, Tamm (DE); Christian Preussner, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/483,010

(22) PCT Filed: Jun. 14, 2002

(86) PCT No.: PCT/DE02/02172

§ 371 (c)(1),
(2), (4) Date: Jun. 15, 2004

(87) PCT Pub. No.: WO03/006810

PCT Pub. Date: Jan. 23, 2003

(65) Prior Publication Data

US 2004/0231653 A1 Nov. 25, 2004

(30) Foreign Application Priority Data

Jul. 11, 2001 (DE) ..... 101 33 555

(51) Int. Cl.[7] ..... F02D 41/14; F02D 41/34
(52) U.S. Cl. ..... 701/109; 123/480; 123/673
(58) Field of Search ..... 123/480, 673, 123/674, 675; 701/104, 109

(56) References Cited

U.S. PATENT DOCUMENTS

| | | | | | |
|---|---|---|---|---|---|
| 5,079,691 | A | * | 1/1992 | Heck et al. | 123/480 |
| 5,307,276 | A | * | 4/1994 | Takahashi et al. | 123/480 |
| 5,713,332 | A | * | 2/1998 | Adler et al. | 701/104 |
| 5,911,682 | A | * | 6/1999 | Kato et al. | 123/673 |
| 6,148,808 | A | | 11/2000 | Kainz | 123/673 |
| 6,276,349 | B1 | * | 8/2001 | Kofler et al. | 123/673 |
| 6,325,056 | B1 | * | 12/2001 | Weining et al. | 123/673 |

FOREIGN PATENT DOCUMENTS

| | | |
|---|---|---|
| DE | 42 13 425 | 10/1992 |
| DE | 197 37 840 | 3/1998 |
| DE | 198 46 393 | 4/2000 |
| DE | 199 03 721 | 7/2000 |

* cited by examiner

*Primary Examiner*—Tony M. Argenbright
(74) *Attorney, Agent, or Firm*—Kenyon & Kenyon

(57) ABSTRACT

A method for cylinder-specific adjustment of the injection quantity in internal combustion engines is provided, as well as an internal combustion engine with which the method may be implemented. The injection quantity per cylinder selected by the engine management is changed in a controlled manner following an orthogonal experimental plan. The effect of this change on the excess-air factor "lambda" is analyzed, allowing the formulation of a regression polynomial to determine necessary corrections of the injection quantity, which injection quantity is adjustable individually for each cylinder with a view to optimum combustion.

11 Claims, 2 Drawing Sheets

| STEP | Lambda | Z1 | Z2 | Z3 | Z4 |
|---|---|---|---|---|---|
| a1 | L_a1 | − | − | − | + |
| a2 | L_a2 | + | − | − | + |
| a3 | L_a3 | − | + | − | − |
| a4 | L_a4 | + | + | − | − |
| ⋮ | ⋮ | ⋮ | ⋮ | ⋮ | ⋮ |

METHOD FOR COMPENSATING INJECTION QUALITY IN EACH INDIVIDUAL CYLINDER IN INTERNAL COMBUSTION ENGINES

FIELD OF THE INVENTION

The present invention relates to a method for operating an internal combustion engine, in particular of a motor vehicle, in which method fuel is injected into the cylinders of the internal combustion engine, the fuel quantity injected into the individual cylinders being adjusted and in which method a lambda value is detected in the exhaust pipe of the internal combustion engine. Moreover, the present invention relates to an internal combustion engine that is suitable for carrying out this method.

BACKGROUND INFORMATION

For pollutant minimization in catalytic aftertreatment of exhaust gases with the aid of a closed-loop, three-way catalytic converter, it is known in the art that the air-fuel mixture should have a specific mass ratio. This ratio is indicated by the so-called excess-air factor "lambda", and can be detected by a lambda sensor located in the exhaust pipe.

In known methods, the values measured by the lambda sensor are fed to a control loop which controls the injection quantities of the individual cylinders as a function of the lambda value during operation of the internal combustion engine.

However, in the case of a single lambda sensor located in the exhaust pipe, this closed-loop control is based only on the lambda value that is averaged over the individual cylinders.

Mixture differences in the individual cylinders which arise in spite of equal injection quantities or equal setpoint values of a control unit for the injection quantities, due to component tolerances and aging effects, cannot be predetermined or taken into account with respect to the calculation of the cylinder-specific injection quantity.

Some methods provide for a temporal assignment of the exhaust gases flowing through the exhaust pipe, and the lambda values thereof, to the individual cylinders. In this manner, the injection quantity can, in principle, be controlled individually for each cylinder by a single lambda sensor, but the measuring accuracy is impaired by mixing effects and turbulences of immediately successive exhaust quantities of different cylinders in the exhaust pipe.

Design approaches in which each cylinder is assigned a lambda sensor are technically very complex.

It is therefore an object of the present invention to provide a method for cylinder-specific adjustment of the injection quantity in internal combustion engines with one lambda sensor located in the exhaust pipe.

SUMMARY

This objective is achieved by a method according to the present invention in which statistical design of experiments theory is utilized to determine the influence of the injection quantities metered to the individual cylinders on the excess-air factor, which is measured in the exhaust pipe and averaged over all cylinders.

In this context, the injection quantities selected by a control unit are gradually changed for each individual cylinder, following an orthogonal experimental plan. After each step of the experimental plan, the lambda value in the exhaust pipe resulting from the change in the injection quantity is measured, and, upon completion of the experimental plan, a correction value for the injection quantity is determined individually for each cylinder using these measured values.

These correction values are used individually for each cylinder to adjust the injection quantities for subsequent injection processes so that the optimum air-fuel mixture is substantially always achieved in each cylinder.

The important advantage of the method according to the present invention is that the optimum injection quantity can be determined for each cylinder of the internal combustion engine using a single lambda sensor.

This is achieved by mathematically modeling the lambda value. To this end, the influence of several independent variables on the value of lambda is determined using a polynomial formulation for the dependent variable lambda.

The independent variables correspond to the injection quantities that are individually metered to each cylinder, so that the mathematical model yields lambda as a function of the injection quantities of the individual cylinders, with coefficients of the polynomial weighting the influence of the injection quantities of the cylinders.

The coefficients can be determined, for example, from the values established within the framework of the orthogonal experimental plan. However, coefficients can also be estimated or established by plausibility considerations.

Depending on the degree of the polynomial selected for the formulation, it is also possible to determine interactions between injection quantities of several cylinders.

Using a setpoint selected for lambda, for example, lambda=1, and solving the resulting equation, a mathematical model for lambda obtained in this manner allows calculation of the injection quantities for each cylinder for which the specified setpoint is reached.

The injection quantities calculated using the mathematical model generally differ from injection quantities selected by the control unit. This difference is essentially due to different combustion conditions and tolerances in the valve control, that is, of the valves of the individual cylinders, and represents the correction value for injection quantity adjustment.

One advantage of the present invention is the possibility of using injectors with far larger tolerances.

In conventional injection systems, the requirements on the flow tolerance of injectors are very high, resulting in correspondingly high reject quantities during manufacturing.

The adjustment method according to the present invention allows proper adjustment of the injection quantities of the individual cylinders even in the case of markedly different flow characteristics of different injectors, making it possible to set lambda to the optimum value for exhaust-gas aftertreatment.

Thus, the method according to the present invention also reduces the manufacturing costs of injection systems and, at the same time, improves the emission performance by using more cost-effective injectors with larger tolerances, and eliminates the influences of these tolerances on the lambda value using the method according to the present invention.

Moreover, the adjustment method according to the present invention has the advantage of not having to be executed during the entire operating time of the internal combustion engine or of the control unit controlling the internal combustion engine. This results in savings in cycle time of the processor of the control unit, which saved cycle time can be used for other purposes.

An embodiment of the method according to the present invention provides to store the determined correction values in the control unit and to retrieve them the next time the vehicle is started. Thus, it is possible to carry out a new adjustment at regular intervals, such as when the vehicle is serviced, and to make the newly determined correction values available for the further operation of the vehicle.

It is also conceivable to determine the correction values periodically during vehicle operation, which allows the system to also respond to short-term changes in the characteristics of the injectors, such as contamination of a nozzle, and to adapt the injection quantities to the new situation individually for each cylinder.

It is also suitable to carry out an adjustment at the manufacturer's site immediately after the manufacture of the motor vehicle.

A further embodiment of the method according to the present invention incorporates the use of a broadband lambda sensor, which allows the lambda value to be determined in an interval from 0.7 <lambda <4 in continuous values.

A further embodiment of the method according to the present invention uses a so-called "voltage-jump sensor," a lambda sensor with a voltage jump in the characteristic. When using this inexpensive sensor type, a change in the lambda value resulting from a change in the injection quantity has to be determined indirectly, for example, from the deviation of a lambda controller, because the voltage-jump sensor has only a voltage jump in the characteristic at lambda=1, i.e., unlike broadband lambda sensors, it does not allow lambda to be determined in continuous values.

Another embodiment of the method according to the present invention provides that the order of a regression polynomial underlying the orthogonal experimental plan is selected as a function of lambda. If, after an adjustment procedure using a regression polynomial of lower order, the desired value of lambda cannot be adjusted with sufficient accuracy, this embodiment allows selection of a higher-order regression polynomial to improve the accuracy of the adjustment method.

The method according to the present invention may be implemented in the form of a computer program which is designed for a control unit of an internal combustion engine, in particular of a motor vehicle. In this context, the computer program is executable, in particular, on a microprocessor, and suitable for carrying out the method according to the present invention. The computer program can be stored on an electric storage medium, such as a flash memory or a read only memory.

DETAILED DESCRIPTION

Figure 1:
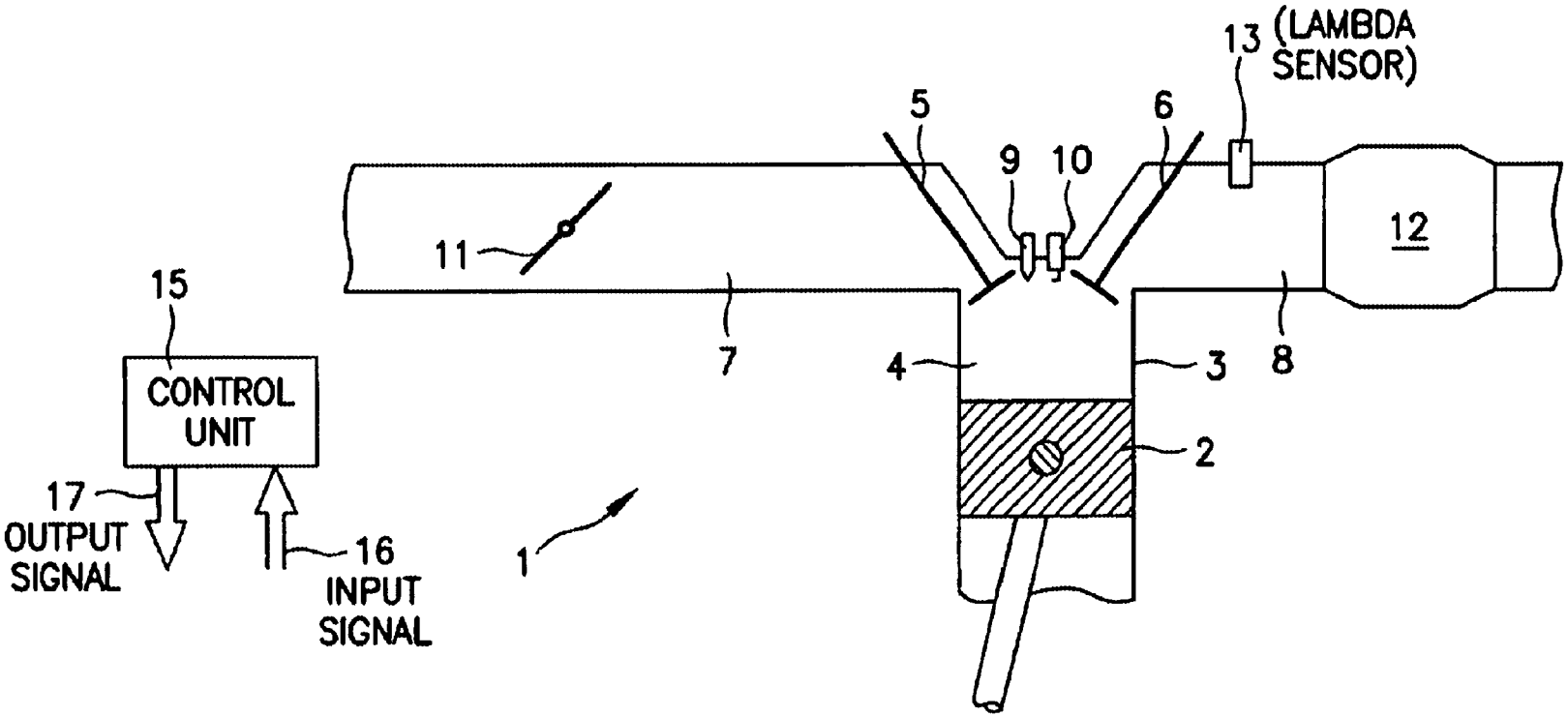
FIG. 1 shows a schematic block diagram of an exemplary embodiment of an internal combustion engine according to the present invention.

FIG. 1 shows an internal combustion engine 1 of a motor vehicle, in which a piston 2 is able to move back and forth in a cylinder 3. Cylinder 3 is provided with a combustion chamber 4, which is bounded, inter alia, by piston 2, an intake valve 5, and an exhaust valve 6. An intake pipe 7 is coupled to intake valve 5, and an exhaust pipe 8 is coupled to exhaust valve 6.

In the region near intake valve 5 and exhaust valve 6, an injector 9 and a spark plug 10 extend into combustion chamber 4. Injector 9 can also be located in intake pipe 7.

Fuel can be injected into the combustion chamber 4 through injector 9. The fuel in combustion chamber 4 can be ignited by spark plug 10.

Accommodated in intake pipe 7 is a rotatable throttle blade 11, by means of which air can be supplied to intake pipe 7. The quantity of supplied air depends on the angular position of throttle blade 11. The exhaust connectors of the individual cylinders 3 merge upstream of catalytic converter 12, forming the exhaust pipe 8, in which is located a lambda sensor 13. Catalytic converter 12 serves to clean the exhaust gases resulting from the combustion of the fuel, and lambda sensor 13 measures the air-fuel ratio in exhaust pipe 8.

During the operation of internal combustion engine 1, fuel is injected through injectors 9 of the individual cylinders 3 into the associated combustion chambers 4. Spark plugs 10 are used to create combustions in combustion chambers 4, causing pistons 2 to reciprocate. These movements are transmitted to a crankshaft (not shown), and exert a torque thereon.

A control unit 15 receives input signals 16 representative of performance quantities of internal combustion engine 1, which are measured by sensors. For example, control unit 15 is connected to an air-mass sensor, a speed sensor, and to lambda sensor 13. Control unit 15 is also connected to an accelerator pedal sensor, which generates a signal that indicates the position of an accelerator pedal capable of being operated by a driver, and which signal thus indicates the requested torque. Control unit 15 generates output signals 17, with which the performance of internal combustion engine 1 can be influenced via actuators. For example, control unit 15 is connected to injector 9, spark plug 10, and throttle blade 11, and the like, and generates the signals required for the control thereof.

Control unit 15 is designed, inter alia, to control the performance quantities of internal combustion engine 1 in open loop and/or in closed loop. For example, the fuel mass injected by injector 9 into combustion chamber 4 is controlled by control unit 15 in open loop and/or in closed loop with a view to low fuel consumption and/or low pollutant emissions. For this purpose, control unit 15 is provided with a microprocessor, in which a computer program is stored in a storage medium, e.g., in a flash memory, the computer program being suitable for carrying out the aforementioned open-loop or closed-loop control.

Figures 2, 3:
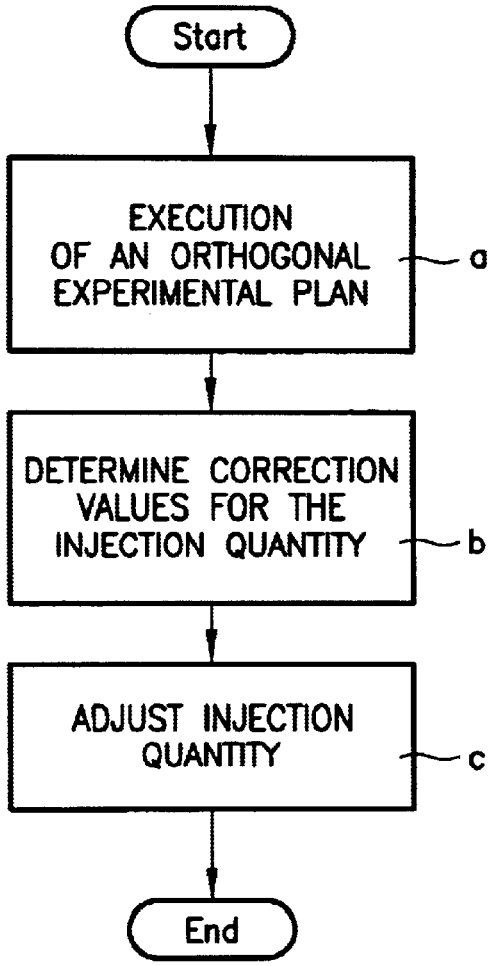
FIG. 2 is a flow chart of an example embodiment of the method according to the present invention.
FIG. 3 shows a chart illustrating a part of an orthogonal experimental plan including four influence variables.

FIG. 2 shows a flow chart of an example embodiment of the method according to the present invention for cylinder-specific adjustment of the injection quantity in an internal combustion engine, which method includes three method steps a), b), and c).

Method step a) of FIG. 2 includes the execution of an orthogonal experimental plan, of which the first four steps a1 through a4 are shown, by way of example, in the table of FIG. 3.

The entire experimental plan has N steps (not all shown) and, according to the number of cylinders of a four-cylinder internal combustion engine 1 selected by way of example, includes four influence variables Z1 through Z4, each of which acts on an associated output variable L_ai (i=1, . . . , N).

Influence variable Zk (k=1, . . . , 4) denotes the injection quantity of cylinder k, that is, the amount of fuel that is metered to cylinder k within the framework of the experimental plan.

Output variable L_ai corresponds to the lambda value of step i (i=1, . . . , N) of the orthogonal experimental plan, which is measured by a lambda sensor 13 in exhaust pipe 8, and averaged over a sufficiently long period of time.

The purpose of the orthogonal experimental plan is to establish an analytical relationship between the lambda value in exhaust pipe 8 and the injection quantities of the individual cylinders 3 in as few steps as possible.

To this end, a quadratic regression function is defined using a polynomial formulation, the quadratic regression function being intended to model lambda as a function of the injection quantities.

A portion of a quadratic regression polynomial for the lambda value in exhaust pipe 8 as a function of the injection quantities of the four cylinders 3 is given below. For the sake of clarity, among higher-order terms in the expression, only those which contain the factor Z1 are shown.

$$\text{lambda}(Z1, Z2, Z3, Z4)=b0+b1*Z1+b2*Z2+b3*Z3+b4*Z4+ b11*Z1*Z1+b12*Z1*Z2+b13*Z1*Z3+b14*Z1*Z4+\ldots$$

To be able to determine the unknown coefficients bi (i=0, . . . , N), bij (i, j=1, . . , N, i<j), and bii (i=1, . . . , N), it is necessary to carry out N+1 steps of the experimental plan.

A step ai is to change the injection quantities for the four cylinders 3, following the scheme Z1, Z2, Z3, Z4 shown in FIG. 3. After that, the lambda value L_ai resulting from this change is measured.

The change in the injection quantity is symbolized by '+' and '−', respectively, with '+' describing an increase in the injection quantity of the corresponding cylinder 3 by, for example, 4%, and '−'describing a reduction by the same factor. The value selected by control unit 15 for the normal operation of internal combustion engine 1 is to be taken in each case as the initial value for this change in the injection quantity.

For example, in step a1 of FIG. 3, the first three cylinders are charged with an injection quantity of only 96%, while the fourth cylinder receives 104%. The associated lambda value $L_{13}$ a1 is detected to be, for example, 1.03. This leads to the following equation:

$$L_a1=103\%=b0+b1*96\%+b2*96\%+b3*96\%+b4*104\%+O(Z*Z)$$

For the sake of clarity, the terms of the order Z*Z are combined to form the addend O(Z*Z).

Given a sufficiently high number N+1 of experimental steps yielding N+1 equations of the type mentioned above, it is possible to determine coefficients bi, bij, bii of the regression polynomial.

Usually, it is even possible to neglect several coefficients, e.g., coefficients of the higher-order terms, thus reducing the computational effort, which means that not all N experimental steps need to be carried out to determine the coefficients.

Knowing the coefficients of regression polynomial lambda(Z1, Z2, Z3, Z4), it is possible to determine correction values for the injection quantity of each cylinder 3 in method step b) of FIG. 2 illustrating the adjustment method according to the present invention. These correction values correspond to the difference between the injection quantities determined as a solution of the equation lambda(Z1, Z2, Z3, Z4)=1 and the injection quantities selected by control unit 15.

In method step c) of FIG. 2, provision is made to adjust the injection quantity selected by control unit 15 for each cylinder 3, using the correction values.

This adjustment process allows the use of more cost-effective injectors with far larger tolerances because it is possible to compensate for even extreme deviations of the properties of an injector by correcting the corresponding injection quantity.

The accuracy of the adjustment can be further increased by selecting a regression polynomial of higher order. Moreover, the order of the regression polynomial is selected as a function of the control performance of the lambda controller.

The measurement of the lambda value is carried out using a broadband lambda sensor 13, which allows lambda to be determined in continuous values in an interval between lambda=0.7 and lambda=4.

The lambda value can also be measured using a voltage-jump sensor, whose characteristic shows a voltage jump at lambda=1. The voltage-jump sensor does not allow lambda to be determined in continuous values, but only detection of the transition from lambda <=0 to lambda >0, and vice versa.

To detect lambda with such a voltage-jump sensor, the injection quantity has to be increased, for example, starting from a first lambda value in the so-called "lean operation" (lambda >1) until the next voltage jump in lambda occurs, i.e., until the change from lambda >1 to lambda <1 takes place.

The increase in the injection quantity required for this is a measure for the first lambda value.

The correction values determined in method step b) of FIG. 2 illustrating the adjustment method according to the present invention are stored in control unit 15, and can be retrieved when starting the motor vehicle, and used to correct the injection quantities.

The correction values can, for example, be stored in an EEPROM memory, which is frequently used for storing performance quantities in control units.

The adjustment method can be carried out for the first time immediately after the manufacture of the motor vehicle. It can also be carried out periodically during vehicle operation, or during maintenance, to allow short-term changes in the injection system to be taken into account in the adjustment.

What is claimed is:

1. A method for adjusting fuel quantities injected into individual cylinders of an internal combustion engine during operation, a lambda value being ascertained in an exhaust pipe of the internal combustion engine during operation, the method comprising:

performing an orthogonal experimental plan, including changing injection quantities selected by a control unit for the individual cylinders over a plurality of steps, wherein, after each step of the experimental plan, the lambda value of the corresponding step is ascertained, the lambda value of the corresponding step being averaged over a plurality of injections;

determining, upon completion of the experimental plan, correction values for the injection quantities of each cylinder based on the ascertained lambda values; and adjusting the injection quantities for the individual cylinders selected by the control unit, based on the correction values.

2. The method as recited in claim 1, further comprising:

storing the correction values in the control unit, wherein the correction values are retrieved at start of the internal combustion engine for use in controlling the operation of the internal combustion engine.

3. The method according to claim 1, wherein the correction values are determined immediately after the manufacture of the internal combustion engine.

4. The method according to claim 1, wherein the correction values are determined periodically during operation of the internal combustion engine.

5. The method according to claim 1, wherein a broadband lambda sensor is used to ascertain the lambda value.

6. The method according to claim 1, wherein a voltage-jump sensor is used to ascertain the lambda value.

7. The method according to claim 1, wherein the order of a regression polynomial underlying the orthogonal experimental plan is selected as a function of the lambda value.

8. A computer-readable medium whose contents cause a control unit of an internal combustion engine to control a method for adjusting fuel quantities injected into individual cylinders of the internal combustion engine during operation, a lambda value being ascertained in an exhaust pipe of the internal combustion engine during operation, the control unit controlling the steps of:

performing an orthogonal experimental plan, including changing injection quantities selected by a control unit for the individual cylinders over a plurality of steps, wherein, after each step of the experimental plan, the lambda value of the corresponding step is ascertained, the lambda value of the corresponding step being averaged over a plurality of injections;

determining, upon completion of the experimental plan, correction values for the injection quantities of each cylinder based on the ascertained lambda values; and adjusting the injection quantities for the individual cylinders selected by the control unit, based on the correction values.

9. The computer-readable medium according to claim 8, wherein the computer-readable medium is a flash memory.

10. A control unit for an internal combustion engine of a motor vehicle, the control unit controlling a method for adjusting fuel quantities injected into individual cylinders of the internal combustion engine during operation, a lambda value being ascertained in an exhaust pipe of the internal combustion engine during operation, comprising:

an arrangement for performing an orthogonal experimental plan, including changing injection quantities selected by a control unit for the individual cylinders over a plurality of steps, wherein, after each step of the experimental plan, the lambda value of the corresponding step is ascertained, the lambda value of the corresponding step being averaged over a plurality of injections;

an arrangement for determining, upon completion of the experimental plan, correction values for the injection quantities of each cylinder based on the ascertained lambda values; and an arrangement for adjusting the injection quantities for the individual cylinders selected by the control unit, based on the correction values.

11. An internal combustion engine of a motor vehicle, comprising:

a control unit controlling a method for adjusting fuel quantities injected into individual cylinders of the internal combustion engine during operation, a lambda value being ascertained in an exhaust pipe of the internal combustion engine during operation, the control unit including:

an arrangement for performing an orthogonal experimental plan, including changing injection quantities selected by a control unit for the individual cylinders over a plurality of steps, wherein, after each step of the experimental plan, the lambda value of the corresponding step is ascertained, the lambda value of the corresponding step being averaged over a plurality of injections;

an arrangement for determining, upon completion of the experimental plan, correction values for the injection quantities of each cylinder based on the ascertained lambda values; and an arrangement for adjusting the injection quantities for the individual cylinders selected by the control unit, based on the correction values.

* * * * *